US008063583B2

(12) United States Patent
Liu

(10) Patent No.: US 8,063,583 B2
(45) Date of Patent: Nov. 22, 2011

(54) DIMMING CIRCUIT FOR CONTROLLING LUMINANCE OF LIGHT SOURCE AND THE METHOD FOR CONTROLLING LUMINANCE

(75) Inventor: Chun-Fu Liu, Jhongli (TW)

(73) Assignee: Chunghwa Picture Tubes, Ltd., Bade (TW)

( * ) Notice: Subject to any disclaimer, the term of this patent is extended or adjusted under 35 U.S.C. 154(b) by 386 days.

(21) Appl. No.: 12/382,083

(22) Filed: Mar. 9, 2009

(65) Prior Publication Data

US 2010/0090615 A1 Apr. 15, 2010

(30) Foreign Application Priority Data

Oct. 14, 2008 (TW) ..... 97139433 A

(51) Int. Cl.
*G05F 1/00* (2006.01)

(52) U.S. Cl. ..... 315/291; 315/209 R; 315/219; 315/223; 315/226; 315/276; 315/307; 315/DIG. 4

(58) Field of Classification Search ..... 315/209 R, 315/219, 223, 226, 227 R, 240, 244, 247, 315/306, 307, 276, 83, DIG. 4, DIG. 72
See application file for complete search history.

(56) References Cited

U.S. PATENT DOCUMENTS 5,426,350 A * 6/1995 Lai ..... 315/244
5,825,137 A * 10/1998 Titus ..... 315/291
5,939,830 A * 8/1999 Praiswater ..... 315/169.3

* cited by examiner

*Primary Examiner* — Haiss Philogene
(74) *Attorney, Agent, or Firm* — Bacon & Thomas, PLLC

(57) ABSTRACT

The present invention provides a dimming circuit for controlling the luminance of a light source and the method for controlling luminance. The dimming circuit comprises an inverter circuit and a driving circuit. The inverter circuit is electrically coupled to a light source to be controlled, to convert a direct current (DC) power input into an alternating current (AC) power. The inverter circuit comprises a transformer, a capacitor connected in parallel to the transformer, a plurality of switches located at both ends of the capacitor, and an oscillating circuit electrically connected to both ends of the transformer. The driving circuit is electrically connected to the inverter circuit, for regulating the AC voltage to control the time period that the light source is turned on. As the input of DC voltage into the transformer is stopped, the driving circuit opens the plurality of switches in the inverter circuit, forming electrical isolation between the capacitor and the transformer, which prevents voltage oscillation and stores the energy into the capacitor.

15 Claims, 3 Drawing Sheets

DIMMING CIRCUIT FOR CONTROLLING LUMINANCE OF LIGHT SOURCE AND THE METHOD FOR CONTROLLING LUMINANCE

TECHNICAL FIELD

The present invention relates generally to a circuit for controlling light source, and more particularly to a dimming circuit for controlling luminance of light source and the method for controlling luminance.

BACKGROUND

With the development and advancement of technology, liquid crystal display (LCD) has replaced the traditional cathode ray tube (CRT) display extensively in the computer, communication and consumer electronics industry. Compared to the traditional CRT display, LCD display has the advantages of being thinner and lighter with low radiation, thus liquid crystal display panels may be suitable for popular electronic products, such as notebooks, personal digital assistants (PDA), mobile phones, digital cameras, flat panel televisions, projectors, digital camcorders, and digital photo frames etc.

Inside the LCD display, back lights of the display are provided by the back light module. Generally speaking, in order to allow users to view the display of liquid crystal display panel clearly under all types of environment, the luminance of the back light needs to be adjustable. Under outdoor lighting environments, the luminance of the back light needs to be brighter than the background lighting, and under darker environments, the luminance of the back light needs to be lowered for providing a softer lighting to reduce eye fatigue. The luminance of liquid crystal displays are usually controlled by the regulation of on/off timing ratio for the back light or by the regulation of electric current going through the back light. The back light module of liquid crystal display panels usually comprises a light source and an inverter circuit for driving the light source. The inverter circuit converts the input direct-current voltage (DC voltage) to alternating-current voltage (AC voltage), and utilizes the AC voltage to drive the light source. As known to those skilled in the art, circuit designers may utilize the principles of LC oscillation to convert direct current to alternating current.

In addition, a popular method for controlling the luminance of a light source is to regulate the pulse width (time period) of the AC voltage supplied to a lamp based on the signals provided by a pulse width modulator (PWM). The wider the pulse width of the AC voltage, the brighter the luminance of the lamp, on the contrary, the narrower the pulse width of the AC voltage, the darker the luminance of the lamp. However, the dimming circuit for controlling luminance of a light source that utilizes the aforementioned LC oscillation principles and pulse width modulators suffers the drawback of having difficulty with lowering the luminance when the lamp is turned off (i.e. PWM signal equals 0) due to LC oscillation. Refer to FIG. 1, it illustrates the output voltage versus time (where time is measured in milliseconds) graphs for the pulse width modulator and the inverter of the dimming circuit for controlling luminance of lamp according to prior art. As shown in FIG. 1, when the signal of the pulse width modulator equals 1, the inverter outputs the AC voltage to the lamp, and controls the luminance of the lamp via time period W (pulse width) of the PWM signal. However, as the PWM signal switches to 0, the output voltage of the inverter needs to endure a period of voltage oscillation before the voltage may be returned to 0 volts, making it difficult to lower the luminance of the lamp.

Refer to FIG. 2, it illustrates the output voltage versus time (where time is measured in microseconds) graphs for the pulse width modulator and the inverter of the dimming circuit for controlling luminance of lamp according to prior art. As shown in FIG. 2, when the PWM signal switches from 1 to 0, voltage oscillation of the inverter may be observed.

U.S. Pat. No. 5,939,830 has disclosed a method and apparatus for dimming a lamp in a backlight of a liquid crystal display, which reduces the period of voltage oscillation. Refer to FIG. 3, it illustrates the circuit diagram for controlling luminance of a lamp according to prior art (U.S. Pat. No. 5,939,830). When switch S1 of dimming circuit 300 is closed (on-state), DC power +V will be applied to the center tap 346 of transformer 340 via inductor L1. As capacitor C1 is connected in parallel to the primary winding 342 of transformer 340, in coordination with the on and off of switches S2 and S3 (controlled by the switch controller 330) will generate LC oscillation between primary winding 342 and capacitor C1. Thus, DC power +V is converted to AC power, and the AC power is applied to the device to be controlled 310 via the secondary winding 344 of transformer 340. In order to control the luminance of the device to be controlled 310, dimming circuit 300 utilizes the pulse width modulator 320 to control the on and off periods of switch S1 for regulating the "on-time" of the device to be controlled 310.

In order to improve on the LC oscillation problem that occurs when the PWM signal is switched from 1 to 0, a switch S4 controlled by the output signal 324 of pulse width modulator 320 is added between inductor L1 and center tap 346. As switch S1 is opened (output signal 322 equals 0), output signal 324 switches from 0 to 1, which closes switch S4 (on-state). Thus, the energy stored at primary winding 342 will be directed to the ground, which greatly reduces the voltage oscillation period for the device to be controlled 310.

However, as the abovementioned solution relies on the connection of primary winding 342 to the ground to improve the effects of LC oscillation, which would lead to a waste of energy, thus the lower the luminance of the device to be controlled 310, the lower the electrical efficiency of the back light module. Also, even if switch S4 is closed at the right moment, LC oscillation would still occur as capacitor C1 is still connected electrically to the primary winding 342 of transformer 340. Therefore, the voltage at the device to be controlled 310 would still need to endure a certain period for voltage to return to 0 volts. As the result, when the luminance of the device to be controlled 310 is low, it becomes more difficult to further lower the luminance of the device to be controlled 310.

The previously described prior art also mentioned that switch S4 may be connected across the secondary winding 344 of transformer 340, thus that the energy stored within transformer 340 is dissipated to ground when switch S1 is opened. This still leads to a waste of energy, and consequently the lower the luminance of the device to be controlled 310, the lower the electrical efficiency of the back light module. Therefore, switch S4 needs to be able to sustain high voltages, thereby increasing the cost of the dimming circuit for controlling luminance of lamps.

Due to the aforementioned problems, the present invention provides a dimming circuit for controlling luminance of light source and the method for controlling luminance. The present invention has the effects of raising the electrical efficiency of the back light module during low luminance, achieves the goal of making it easier to lower the luminance of lamps with a lower cost, and reduces the waste of energy.

SUMMARY OF THE INVENTION

An object of the present invention is to provide a dimming circuit for controlling luminance of light source, such that the luminance of lamps may be further lowered with ease under low luminance conditions.

Another object of the present invention is to provide a dimming circuit for controlling luminance of light source, such that the efficiency of back light modules may be raised under low luminance conditions.

Yet another object of the present invention is to provide a dimming circuit for controlling luminance of light source, such that electrical isolation between the capacitor and the inductor within the circuit may be established to avoid LC oscillation, thus voltage across the lamp may be quickly lowered to near 0 volts, and the energy may be stored in the capacitor to reduce the waste of energy.

The present invention provides a dimming circuit for controlling luminance of light source, to control the luminance of a device to be controlled. The dimming circuit comprises an inverter circuit and a driving circuit. The inverter circuit is electrically coupled to the device to be controlled to convert the input DC power to AC power, and outputs the AC power to the device to be controlled. The inverter circuit includes a transformer, a capacitor connected in parallel to the transformer, and a plurality of switches located on both sides of the capacitor. The driving circuit is electrically connected to the inverter circuit for controlling the supply of DC power, and controls the plurality of switches when the input of DC power into the transformer is stopped, thus that electrical isolation is formed between the capacitor and the transformer.

The present invention provides a dimming circuit for controlling luminance of light source, comprising: a light source, a DC power supply, a power switch, an inverter circuit and a pulse width modulator. The DC power supply is used to provide DC power, and the power switch is electrically connected to the DC power supply. The inverter circuit is electrically connected to the light source for converting DC power to AC power. The inverter circuit includes: a transformer with a primary winding and a secondary winding; a capacitor connected in parallel to the primary winding of the transformer; a first set of switches electrically connected to the primary winding of the transformer; a switch controller electrically connected to the first set of switches, for turning the switches on and off to generate LC oscillations for the capacitor and the primary winding; and a second set of switches located at both sides of the capacitor. The pulse width modulator is electrically connected to the power switch and the second set of switches for controlling the output signal of the power switch, and controls the second set of switches when the output of DC power is stopped, thus the capacitor is electrically isolated to the transformer.

The present invention provides a method for controlling luminance of a light source, which comprises the following steps. Firstly, DC power is supplied to an inverter such that AC power is outputted from the inverter to a light source to be controlled. Then, as the supply of DC power into the inverter is stopped, the capacitor and the transformer in the inverter are isolated, and the inverter is electrically isolated to the ground, thereby allowing energy to be stored within the capacitor inside the inverter.

BRIEF DESCRIPTION OF THE DRAWINGS

The present invention may be understood by the detailed descriptions of some preferred embodiments outlined in the specification and the drawings attached. However, it should be appreciated that all the preferred embodiments of the invention are for illustration, and not for limiting the scope of the present invention, wherein.

DETAILED DESCRIPTION

Some preferred embodiments of the present invention will now be described in greater detail. However, it should be recognized that the present invention can be practiced in a wide range of other embodiments besides those explicitly described, and the scope of the present invention is not expressly limited except as specified in the accompanying claims.

Figure 1:
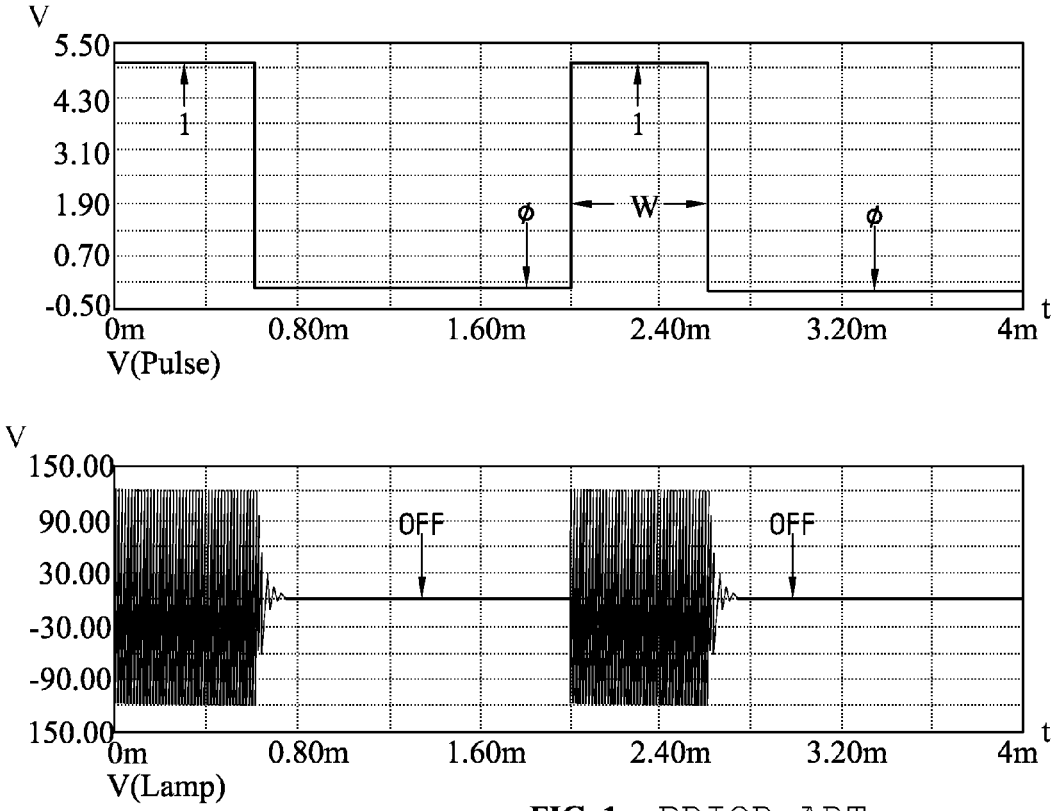
FIG. 1 PRIOR ART
FIG. 1 illustrates the output voltage versus time (where time is measured in milliseconds) graphs for the pulse width modulator and the inverter of the dimming circuit for controlling luminance of lamp according to prior art.
Figure 2:
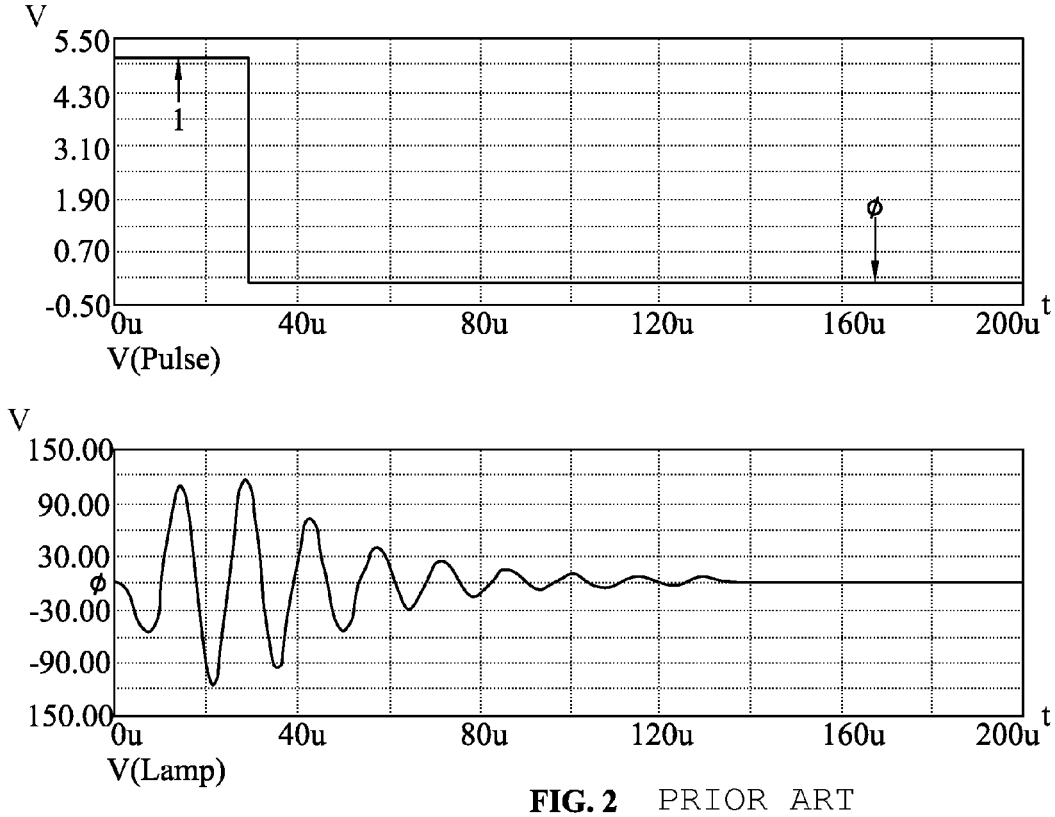
FIG. 2 PRIOR ART
FIG. 2 illustrates the output voltage versus time (where time is measured in microseconds) graphs for the pulse width modulator and the inverter of the dimming circuit for controlling luminance of lamp according to prior art.
Figure 3:
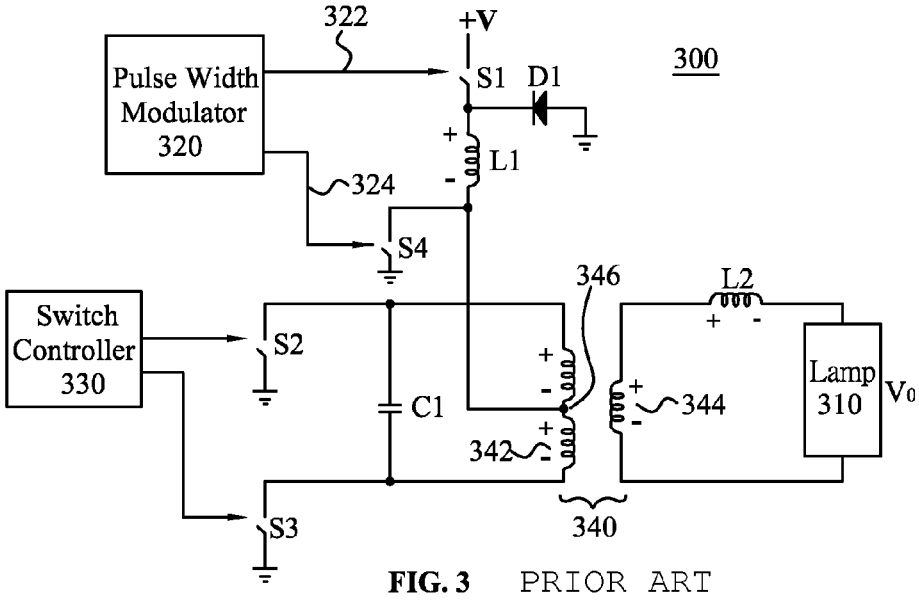
FIG. 3 PRIOR ART
FIG. 3 illustrates the circuit diagram for controlling luminance of lamp according to prior art.
Figure 4:
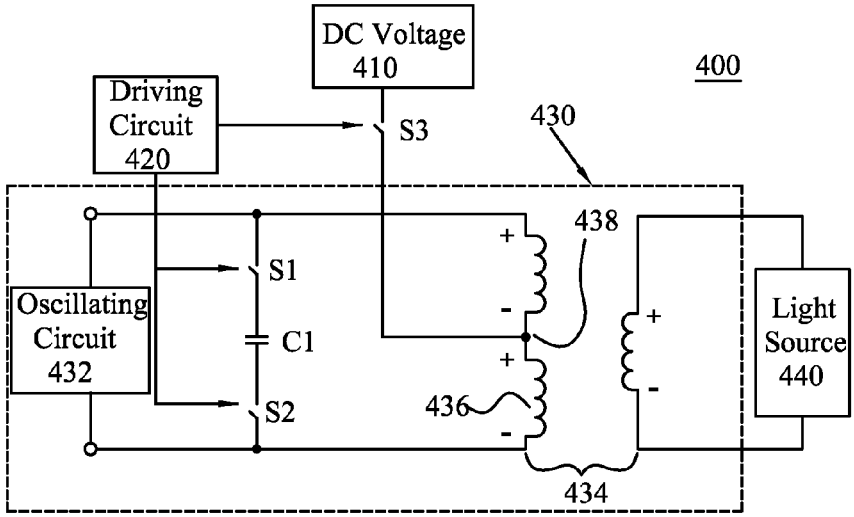
FIG. 4 illustrates the circuit diagram for controlling luminance of light source according to present invention.

Refer to FIG. 4, it illustrates the circuit diagram for controlling luminance of light source according to present invention. As shown in FIG. 4, the dimming circuit for controlling luminance of light source 400 is coupled to DC power 410, and the driving circuit 420 is electrically coupled to the inverter circuit 430 and switch S3. In one embodiment, inverter circuit 430 comprises an oscillating circuit 432, a transformer 434, a capacitor C1 and switches S1 and S2. A device to be controlled 440 is coupled to inverter circuit 430. In this instance, the device to be controlled 440 may be a light source, such as a lamp. Capacitor C1 is connected in parallel to the primary winding 436 of transformer 434, and switches S1 and S2 are located at both sides of capacitor C1. The on and off of switches S1 and S2 are controlled by driving circuit 420. Due to the fact that capacitor C1 is connected in parallel to the primary winding 436 of transformer 434, which in coordination with oscillating circuit 432 will generate LC oscillation between capacitor C1 and primary winding 436 when DC power 410 is applied to the center tap 438 of transformer 434 via switch S3 (controlled by driving circuit 420), thereby converts the DC power to AC power.

In some embodiments, when the input of DC power 410 to transformer 434 is stopped, switches S1 and S2 may be opened (open circuit) via driving circuit 420, thereby forming electrical isolation between capacitor C1 and transformer 434, thus voltage oscillation may be avoided and energy can be stored in capacitor C1. Driving Circuit 420 may control the supply of power via switch S3, and regulates the luminance of light source 440 by controlling the time period that light source 440 is turned on.

Figure 5:
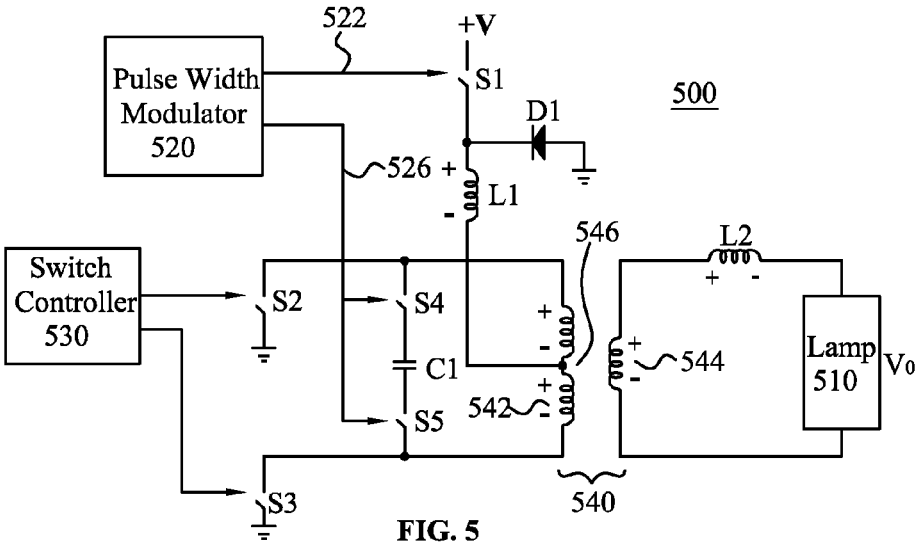
FIG. 5, illustrates the preferred embodiment of the circuit diagram for controlling luminance of lamp according to present invention.

Refer to FIG. 5, which illustrates the preferred embodiment of the circuit diagram for controlling luminance of lamp according to present invention. When switches S4 and S5 are closed (turned on) along with switch S1 (turned on) in the dimming circuit for controlling luminance of lamp 500, DC power +V will be applied to the center tap 546 of the transformer 540 via inductor L1. Due to the fact that capacitor C1 is connected in parallel to the primary winding 542 of transformer 540, by turning switches S2 and S3 on and off via the switch controller 530 will generate LC oscillation between primary winding 542 and capacitor C1. Thus, DC power +V will be converted to AC power, and the AC power will be applied to the device to be controlled 510 via the secondary winding 544 of transformer 540 and the ballast L2. Ballast L2 may prevent any damage caused by the entering of heavy currents into the device to be controlled 510.

In the embodiment, switches S4 and S5 are located at both sides of capacitor C1, respectively, and utilize the output signal 526 of the pulse width modulator 520 to control the switches (short circuit or open circuit). When driving the illumination of the device to be controlled 510, the output signal 526 of pulse width modulator 526 equals 1, thus switches S4 and S5 are closed (on-state). When regulating the luminance of the device to be controlled 510, the output signal 522 changes from 1 to 0 for the adjustment of period W, thereby regulating the luminance of the device to be controlled 510. At the same time that output signal 522 is changed from 1 to 0, the other output signal 526 of pulse width modulator 520 also changes from 1 to 0. In this instance, switches S4 and S5 have an open status (open circuit) to completely isolate capacitor C1 and primary winding 542 of transformer 540 electrically. In addition, switches S2 and S3 are opened (open circuit) via switch controller 530. As capacitor C1 and primary winding 542 of transformer 540 are completely isolated (electrically), therefore LC oscillation will not occur. Thus the voltage applied to the device to be controlled 510 will quickly drop to around 0 volts as the output signal 522 changes from 1 to 0, thereby prevents voltage oscillation from happening. In some embodiments, the device to be controlled 510 may be a light source, such as cold cathode fluorescent light (CCFL), light-emitting diode (LED), incandescent light or halogen lamp.

Figure 6:
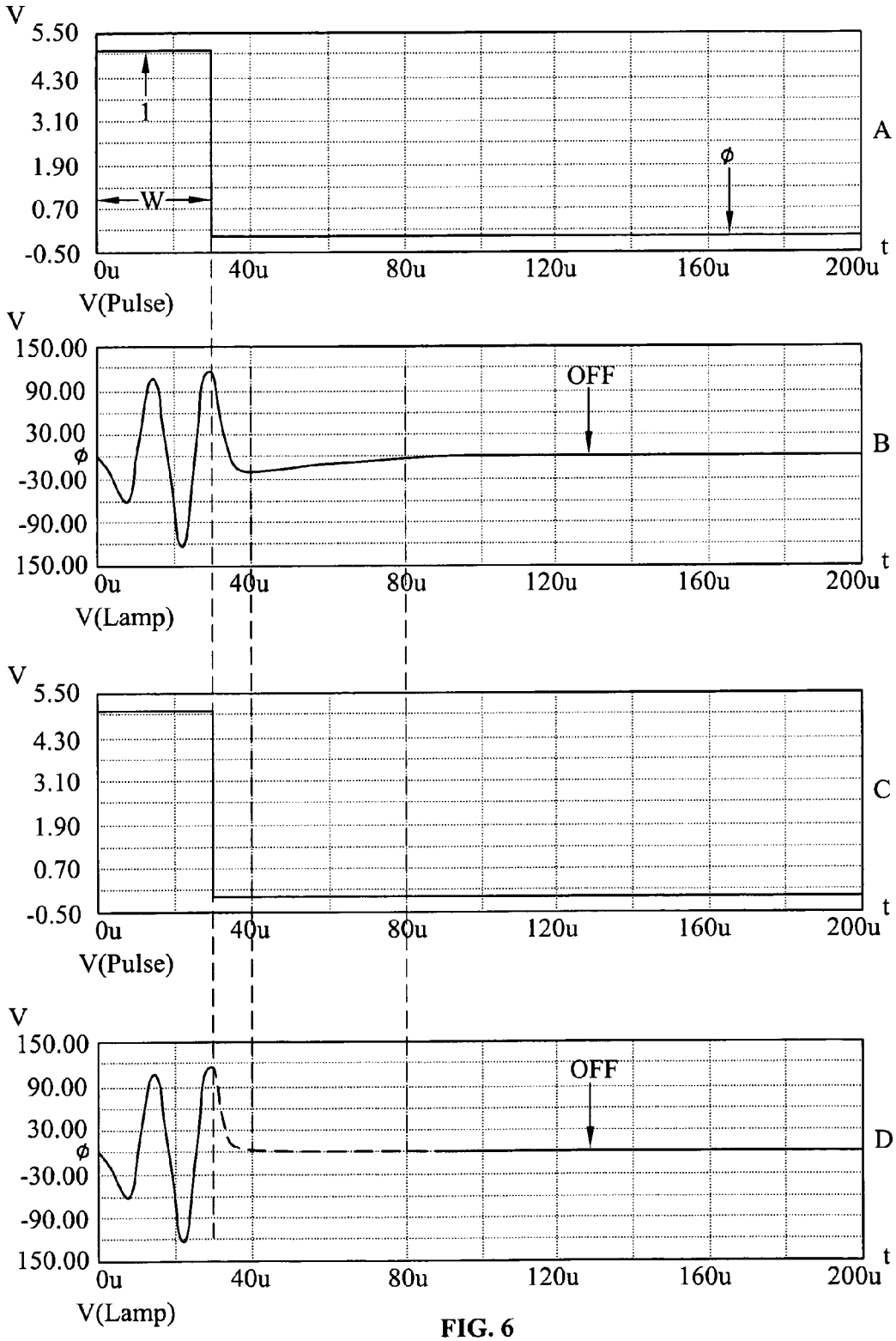
FIG. 6 illustrates the output voltage versus time (where time is measured in microseconds) graphs for the pulse width modulator and the inverter of the dimming circuit for controlling luminance of lamp according to prior art and present invention.

FIG. 6 illustrates the output voltage versus time (where time is measured in microseconds) graphs for the pulse width modulator and the inverter of the dimming circuit for controlling luminance of lamp according to prior art and present invention. As shown, voltage waveforms A and B represent the voltage waveforms according to prior art, where voltage waveform A represents the voltage waveform for the output signal 322 of pulse width modulator 320, and voltage waveform B represents the theoretical voltage waveform of the device to be controlled 310. On the other hand, voltage waveforms C and D represent the voltage waveforms according to the present invention, where voltage waveform C represents the voltage waveform for the output signal 522 of pulse width modulator 520, and voltage waveform D represents the theoretical voltage waveform of the device to be controlled 510. By comparing voltage waveform B with voltage waveform D, it is obvious that the voltage applied to the device to be controlled 510 according to the present invention did not experience any voltage oscillation. As there is no voltage oscillation when output signal 522 is changed from 1 to 0, the contributions toward the illumination of the device to be controlled 510 would mostly come from the voltage waveforms within time period W. In other words, compared to prior art, under low luminance conditions, it would be much easier for the device to be controlled 510 in the present invention to further lower its luminance, thus the margin for the lowering of luminance may be increased.

In addition, because both switches S4 and S5 are opened (open circuit), and switches S2 and S3 have also been opened, the energy will be stored in capacitor C1. As the dimming circuit for controlling the luminance of lamp provided by the present invention is able to store energy, electricity may be further saved when back light modules are under low luminance conditions, with a better electrical efficiency. Moreover, as switches S5 and S6 have no requirement for sustaining high voltage, standard transistor switches may be employed to lower the cost of luminance control for lamps.

According to an aspect of the present invention, the present invention has further provided a method for controlling luminance of lamp. The steps involved are outlined below.

The present invention provides a DC power to an inverter (comprising a capacitor and a transformer) in the first place, such that an AC power may be outputted from the inverter. Then, the AC power is outputted to both ends of a lamp for illuminating the lamp. After that, a pulse width modulator is utilized for controlling the time period W that DC power is inputted to the inverter. During the period that input of DC power into the inverter is stopped, the capacitor and the transformer within the inverter are electrically isolated, and the inverter and the ground are also electrically isolated, thus allows the energy to be stored inside the capacitor within the inverter.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

What is claimed is:

1. A dimming circuit for controlling luminance of light source, used to control the luminance of a device to be controlled, comprising:

an inverter circuit, electrically coupled to said device to be controlled for converting DC power inputted to AC power, and outputs said AC power to said device to be controlled, wherein said inverter circuit includes:

a transformer;

a capacitor, connected in parallel to said transformer;

a plurality of switches, located at both sides of said capacitor; and a driving circuit, electrically connected to said inverter circuit for regulating the supply of DC power, and controlling said plurality of switches when input of DC power into said transformer is stopped, thereby forming electrical isolation between said capacitor and said transformer.

2. The dimming circuit for controlling luminance of light source of claim 1, further comprising an oscillating circuit electrically connected to both sides of said transformer, thereby forming LC oscillation between said transformer and said capacitor.

3. The dimming circuit for controlling luminance of light source of claim 2, wherein said oscillating circuit comprises a switch controller and two switches connected to ground.

4. The dimming circuit for controlling luminance of light source of claim 1, wherein said driving circuit comprises a pulse width modulator.

5. The dimming circuit for controlling luminance of light source of claim 1, further comprising a ballast located between said light source and said inverter circuit.

6. The dimming circuit for controlling luminance of light source of claim 1, wherein said light source may be cold cathode fluorescent light (CCFL), light-emitting diode (LED), incandescent light or halogen lamp.

7. A dimming circuit for controlling luminance of light source, comprising:

a DC power supply, for providing DC power;

a power switch, electrically connected to said DC power supply;

an inverter circuit, electrically connected to said light source for converting said DC power to AC power, said inverter circuit includes:

a transformer, with a primary winding and a secondary winding;

a capacitor, connected in parallel to said primary winding of said transformer;

a first set of switches, electrically connected to said primary winding of said transformer;

a switch controller, electrically connected to said first set of switches for tuning said first set of switches on and off, thereby generating LC oscillation between said capacitor and said primary winding;

a second set of switches, located at both sides of said capacitor; and a pulse width modulator, electrically connected to said power switch and said second set of switches for regulating output signal of said power switch, and controlling said second set of switches when output of DC power is stopped, forming electrical isolation for said capacitor and said transformer.

8. The dimming circuit for controlling luminance of light source of claim 7, further comprising a ballast located between said light source and said secondary winding of said transformer.

9. The dimming circuit for controlling luminance of light source of claim 7, wherein said light source may be cold cathode fluorescent light (CCFL), light-emitting diode (LED), incandescent light or halogen lamp.

10. A method for controlling luminance of light source comprising the steps of:

supplying DC power to an inverter, thereby allowing said inverter to output AC power to a light source to be controlled;

isolating a capacitor and a transformer within said inverter when input of said DC power into said inverter is stopped, and controlling said inverter to be isolated with ground, allowing energy to be stored inside said capacitor within said inverter.

11. The method for controlling luminance of light source of claim 10, further comprising a ballast located between said light source and said transformer.

12. The method for controlling luminance of light source of claim 10, further comprising the utilization of a pulse width modulator for regulating the time period that DC power is inputted into said inverter.

13. The method for controlling luminance of light source of claim 10, further comprising the provision of an oscillating circuit that is electrically connected to both sides of said transformer, generating LC oscillation for said transformer and said capacitor.

14. The method for controlling luminance of light source of claim 13, wherein said oscillating circuit comprises a switch controller and two switches connected to ground.

15. The method for controlling luminance of light source of claim 10, further comprising the provision of a set of switches located at both sides of said capacitor for the convenience of controlling the status of said capacitor.

* * * * *